US007111436B2

(12) United States Patent
Saiz

(10) Patent No.: US 7,111,436 B2
(45) Date of Patent: Sep. 26, 2006

(54) LIFESAVING SYSTEM FOR BUILDINGS

(76) Inventor: Manuel Munoz Saiz, Los Pico 5, 3, 6, Almeria (ES) 04004

( * ) Notice: Subject to any disclaimer, the term of this patent is extended or adjusted under 35 U.S.C. 154(b) by 333 days.

(21) Appl. No.: 10/680,582

(22) Filed: Oct. 7, 2003

(65) Prior Publication Data

US 2005/0055895 A1 Mar. 17, 2005

(30) Foreign Application Priority Data

Aug. 13, 2003 (ES) ..... 200302042

(51) Int. Cl.
*E04C 3/30* (2006.01)

(52) U.S. Cl. ..... 52/732.1; 182/48

(58) Field of Classification Search ..... 52/732.1, 52/309.8; 182/48, 239, 71, 72, 76
See application file for complete search history.

(56) References Cited

U.S. PATENT DOCUMENTS 4,240,520 A * 12/1980 LaGrone et al. ..... 182/48
5,620,058 A * 4/1997 Forrester ..... 182/48

* cited by examiner

*Primary Examiner*—Naoko Slack
*Assistant Examiner*—Jessica Laux
(74) *Attorney, Agent, or Firm*—Robert M. Schwartz

(57) ABSTRACT

The lifesaving system for buildings of the present invention includes a tubular device having opened crowns or circular radial curved crowns attached to an inside wall of the tubular device, the crowns having flexible vanes or fins through which inverted bell-shaped elements pass, the elements larger in size than the inner size of the crowns, and are braked or slowed as they move downwards, a foam rubber element added at an end of the tubular device, and an annular element having an outside perimeter forming a tapered cone and curved, and which adapts to a top of a user's chest and is positionable under user's armpits.

10 Claims, 1 Drawing Sheet

LIFESAVING SYSTEM FOR BUILDINGS

CROSS-REFERENCE TO RELATED APPLICATIONS

This application claims the priority date of Spanish Patent P200302042 filed on Aug. 13, 2003. The basis for priority in this case is the Paris Convention for the Protection of Industrial Property (613 O.G. 23,53 Stat 1748). The Spanish patent application was filed in The Official Patent and Trademarks Office of Spain.

TECHNICAL FIELD OF THE INVENTION

The present invention relates to the rescue of people from buildings due to fire, smoke, and other dangerous conditions.

BACKGROUND OF THE INVENTION

There are at present no devices for saving people trapped in buildings, particularly in tall buildings where external resources cannot be used.

SUMMARY OF THE INVENTION

The lifesaving system for buildings in the present invention consists of a tubular device which can be opened lengthwise and laterally, with opened crowns or circular radial curved crowns attached to the inside wall, having on the inside of the crowns flexible vanes or fins through which inverted bell-form elements pass, the elements somewhat larger in size than the inner size of the crowns, the elements braked or slowed as they move downwards, with the persons, animals or objects descending inside them.

The tubular device may be rigid or foldable, made of fabric or of three or more cords carrying rings which in turn hold the vanes or fins crowns.

The tubular device and crown may be of circular or elliptical cross-section, and on one variant of the crown, the vanes or fins form two ellipses for the fitting of shoes, with an inner hole of somewhat smaller size.

A variant uses an annular element, whose outside perimeter is a tapered cone and curved, and which adapts to the top of the chest, and under the armpits, and a similar element may be adapted around the legs, with an additional central diameter support.

The bell-shaped elements may also have a lug or flange which is flexible or of vane or fin form.

For lesser heights, the ducting can be used on a slope with just the vanes or fins for support of the back or rear. Reinforced trousers may also be used.

At the bottom, the vanes or fins may be closer together or stronger, to further reduce the speed of drop. A foam rubber element may be added at the end.

Reinforced gloves can be used to control descent, which can also be regulated with pressure on the flexible bell lugs.

If the tube has no side opening, gates can be added. The present invention has the following advantages: Very useful, economical, simple, the equipment can be recovered and is long lasting, it saves lives and in some cases can be used to reduce phobias caused by tall buildings.

DETAILED DESCRIPTION OF THE INVENTION

Figure 1:
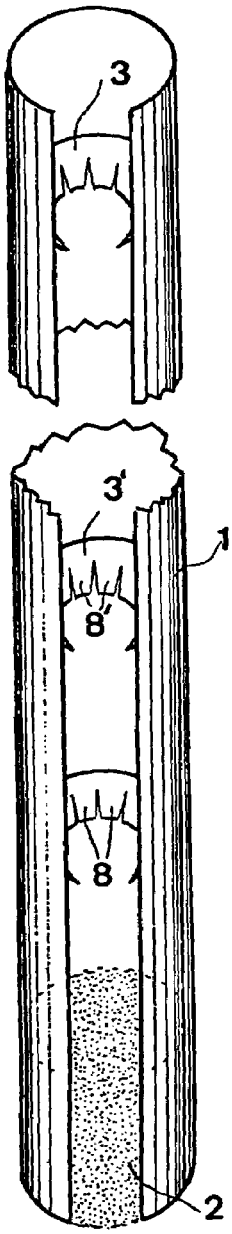
FIG. 1 shows a schematic, perspective and partial view of the device in the invention.

FIG. 1 consists of the tubular device (1) which can be opened lengthwise and laterally, the foam rubber element (2), with opened crowns or circular, radial curved crowns and opened (3 and 3') attached to the inside wall, having on the inside of said crowns and radial there are flexible vanes or fins (8 and 8) through which inverted bell-form elements (6, FIG. 4) pass which, said elements somewhat larger in size than the inner smaller size of the crowns, are braked or slowed as they move downwards, like the persons, animals or objects descending inside them.

Figure 2:
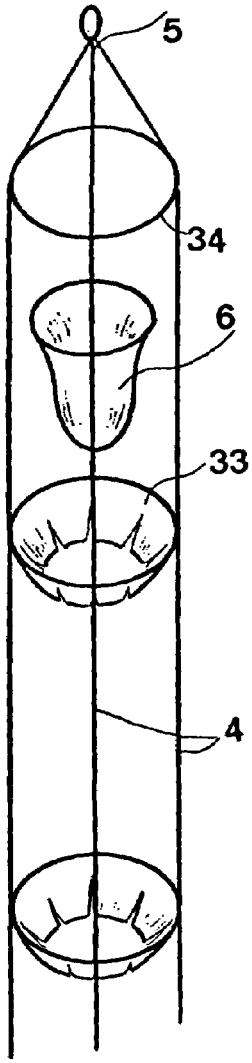
FIG. 2 shows a schematic, perspective and partial view of a variant of the device.

FIG. 2 of the crown (33), the cords or flexible tubular wall made of fabric that can be folded (4), the upper support element (5), the bell-form element (6) and its ring (34).

Figure 3:
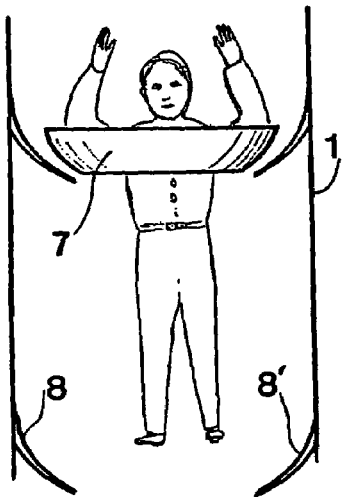
FIG. 3 shows a schematic, side and partial view of the device.

FIG. 3 consists of the annular element (7), whose outside perimeter is a tapered cone and curved, and which adapts to the top of the chest, and under the armpits, and the vanes or fins (8 and 8').

Figure 4:
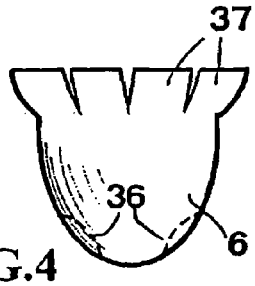
FIG. 4 shows a schematic side view of a bell-shape element.

FIG. 4 consists of the bell-shaped element (6) and the vanes, lug or flange (37) and the holes (36) to introduce the legs.

Figure 5:
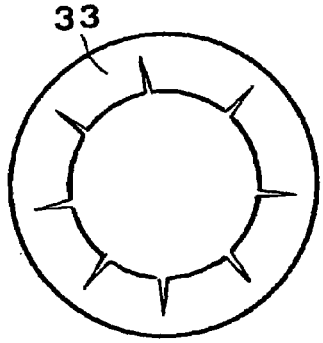
FIG. 5 to 7 show a schematic plant views of different crowns.

FIG. 5 consists of the circular crown (33).

Figure 6:
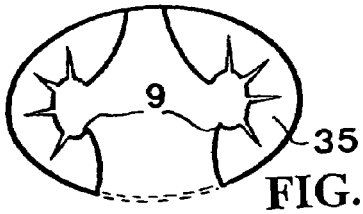

FIG. 6 consists of the elliptical crown (35), where the vanes or fins form two ellipses for the fitting of shoes, their inner hole (9) of somewhat smaller size than them. This can be used by the more experienced people.

Figure 7:
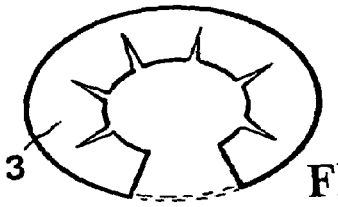

FIG. 7 consists of the open elliptical crown (3).

What is claimed is:

1. A lifesaving system for buildings comprising:

a tubular device having opened crowns or circular radial curved crowns attached to an inside wall of said tubular device, wherein said crowns include flexible vanes or fins through which inverted bell-shaped elements pass, said elements larger in size than an inner size of said crowns, said elements braked or slowed as they move downwards, a foam rubber element at an end of said tubular device; and an annular element having an outside perimeter forming a tapered cone and curved, and which adapts to the top a user's the chest and is positionable under said user's armpits.

2. The lifesaving system according to claim 1 wherein said tubular device is open lengthwise and laterally.

3. The lifesaving system according to claim 1 wherein said tubular device is rigid.

4. The lifesaving system according to claim 1 wherein said tubular device is foldable and flexible.

5. The lifesaving system according to claim 4 wherein said tubular device is formed of three or more cords carrying rings to hold said vanes or fins.

6. The lifesaving system according to claim 1 wherein said tubular device and said crown have a circular cross-section.

7. The lifesaving system according to claim 1 wherein said tubular device and said crown have an elliptical cross-section.

8. The lifesaving system according to claim 1 wherein said vanes or fins form two ellipses for the fitting of shoes.

9. The lifesaving system according to claim 1 wherein said bell-shaped elements have a lug or flange which is flexible.

10. The lifesaving system according to claim 1 wherein at a bottom of said tubular device said vanes or fins are closely positioned to reduce speed of a drop.

* * * * *